US009849696B2

(12) United States Patent
Prebensen et al.

(10) Patent No.: US 9,849,696 B2
(45) Date of Patent: Dec. 26, 2017

(54) PRINTING ON PACKAGING MATERIAL IN MULTILANE FLOW WRAPPING MACHINE

(71) Applicant: Tetra Laval Holdings & Finance S.A., Pully (CH)

(72) Inventors: Uffe Prebensen, Støvring (DK); Torben-Brander Nedergaard, Ryomgaard (DK); Soeren Kjerulf, Ebeltoft (DK)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 15/385,276

(22) Filed: Dec. 20, 2016

(65) Prior Publication Data

US 2017/0173977 A1 Jun. 22, 2017

(30) Foreign Application Priority Data

Dec. 21, 2015 (DK) ..... 2015 70846

(51) Int. Cl.

| | |
|---|---|
| ***B41J 3/62*** | (2006.01) |
| ***B41J 15/18*** | (2006.01) |
| ***B41J 11/00*** | (2006.01) |
| ***B65B 61/02*** | (2006.01) |

(52) U.S. Cl.

CPC ..... *B41J 11/0045* (2013.01); *B41J 3/62* (2013.01); *B65B 61/025* (2013.01)

(58) Field of Classification Search

CPC ..... B41J 3/62; B41J 3/28; B41J 2002/14379
See application file for complete search history.

(56) References Cited

U.S. PATENT DOCUMENTS

| | | | |
|---|---|---|---|
| 1,826,446 | A | 10/1931 | Barber |
| 3,728,962 | A | 4/1973 | Sherrington |
| 5,371,521 | A | 12/1994 | Wehrmann |
| 6,416,798 | B1 | 7/2002 | Gentine et al. |

(Continued)

FOREIGN PATENT DOCUMENTS

| | | | |
|---|---|---|---|
| GB | 1028718 | A | 5/1966 |
| GB | 2130169 | A | 5/1984 |
| GB | 2353974 | A | 3/2001 |

OTHER PUBLICATIONS

Extended European Extended Search Report dated May 17, 2017 by the European Patent Office in corresponding European Patent Application No. 16201108.4 (5 pages).

(Continued)

*Primary Examiner* — Geoffrey Mruk
*Assistant Examiner* — Scott A Richmond
(74) *Attorney, Agent, or Firm* — Buchanan Ingersoll & Rooney PC

(57) ABSTRACT

The invention relates to multilane printer for printing packaging material. The printer comprises a first lane for packaging material, a second lane for packaging material, and a printer head arranged in connection with the lanes. The lanes are arranged laterally offset in an overlapping manner, such that the printer head is able to simultaneously print on at least a portion of the packaging material travelling in each lane. The invention also relates to a multilane wrapping machine and a method for simultaneously printing a plurality of lanes for packaging material using one single printer head.

13 Claims, 3 Drawing Sheets

(56) References Cited

U.S. PATENT DOCUMENTS

| | | | | |
|---|---|---|---|---|
| 6,837,023 | B1 * | 1/2005 | Glatfelter, Jr. | B65B 43/123 101/44 |
| 8,607,102 | B2 * | 12/2013 | Sampath | G06F 11/0733 714/46 |
| 2009/0007811 | A1 * | 1/2009 | Weingartner | B41J 3/407 101/483 |

OTHER PUBLICATIONS

International Search Report (PCT/ISA/210) dated Jul. 20, 2016, by the Danish Patent Office as the International Searching Authority for International Application No. PA 2015 70846.

* cited by examiner

PRINTING ON PACKAGING MATERIAL IN MULTILANE FLOW WRAPPING MACHINE

TECHNICAL FIELD

The invention relates to a multilane printer for printing packaging material, a multilane wrapping machine, and a method for printing packaging material.

BACKGROUND ART

The present invention relates to the packaging of ice-cream bars and other objects, wherein the objects are conveyed in rows from a production machine and deposited on a number of lanes of packaging material carried forward side-by-side.

Usually when carrying out the above-mentioned multilane technique, the number of lanes of packaging material conveyed in parallel is the same as the number of objects in each row. The simultaneous depositing of a whole row of objects on the parallel lanes has some advantages over the so-called single lane technique, where a row of objects is deposited simultaneously on an intermediate conveyor, from which the objects are transported one after the other to a single line of packaging material. The rate of wrapping is lower as a consequence of the parallel-conveyed lines, which increases the operational security of the apparatus and gives better conditions for heat sealing of the packaging material. When the objects can be deposited directly from the production machine, an intermediate conveyor may be eliminated so that the problems connected therewith are avoided, such as hygienic problems when wrapping foodstuffs.

The usual multi-lane technique also has some disadvantages. One of them is that the solution is not space efficient. Another disadvantage is that the amount of components necessary for the conventional multilane technique is high.

SUMMARY OF THE INVENTION

It is an object of the present invention to mitigate, alleviate or eliminate one or more of the above-identified deficiencies in the art and disadvantages singly or in any combination and solve at least the above mentioned problem.

According to a first aspect, these and other objects are achieved in full, or at least in part, by a multilane printer for printing packaging material. The printer comprises a first lane for guiding packaging material, a second lane for guiding packaging material, and a printer head arranged in connection with said lanes. The lanes are arranged laterally offset in an overlapping manner, such that said printer head is able to simultaneously print on at least a portion of the packaging material travelling in each lane. Since only one single printer head is used for all of the lanes the wrapping machine will be more cost and space efficient. In turn, the construction will allow for a much more compact layout of the printing arrangement and for better accessibility to the printer for maintenance of the same. The lanes may also be arranged offset in height when passing the printer head in order to gain additional space and to avoid being in contact with each other.

Naturally, the number of lanes of the printer may be varied. However, in a preferred embodiment of the present invention, the printer comprises four lanes and is a static printer, for example a laser printer.

The portion of the packaging material may be an edge of the packaging material, and the print may comprise a date coding and/or a batch number.

A distance between the printer head and the packaging material of the lane arranged furthest away from the printer head preferably is between 20 and 500 mm. These are the maximum distances for which a clear print can be obtained.

According to a second aspect, the objects are achieved in full, or at least in part, by a multilane wrapping machine for wrapping objects in bags of packaging material. The wrapping machine comprises a printer as described above.

In order to handle the packaging material in a simple and space efficient way, the wrapping machine may further comprise a roller for each lane of said printer onto which said packaging material is wound. Additionally, the wrapping machine may comprise at least one guiding means for each lane of said printer adapted to guide the packaging material in said lane.

According to a third aspect, the objects are achieved in full, or at least in part, by a method for simultaneously printing a plurality of lanes of packaging material using one single printer head. The method comprises arranging the lanes laterally offset in an overlapping manner, advancing packaging material in the lanes, and printing at least a portion of the packaging material in each lane simultaneously using said printer head.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of the element, device, component, means, step, etc., unless explicitly stated otherwise.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF PREFERRED EMBODIMENTS OF THE INVENTION

Figure 1A:
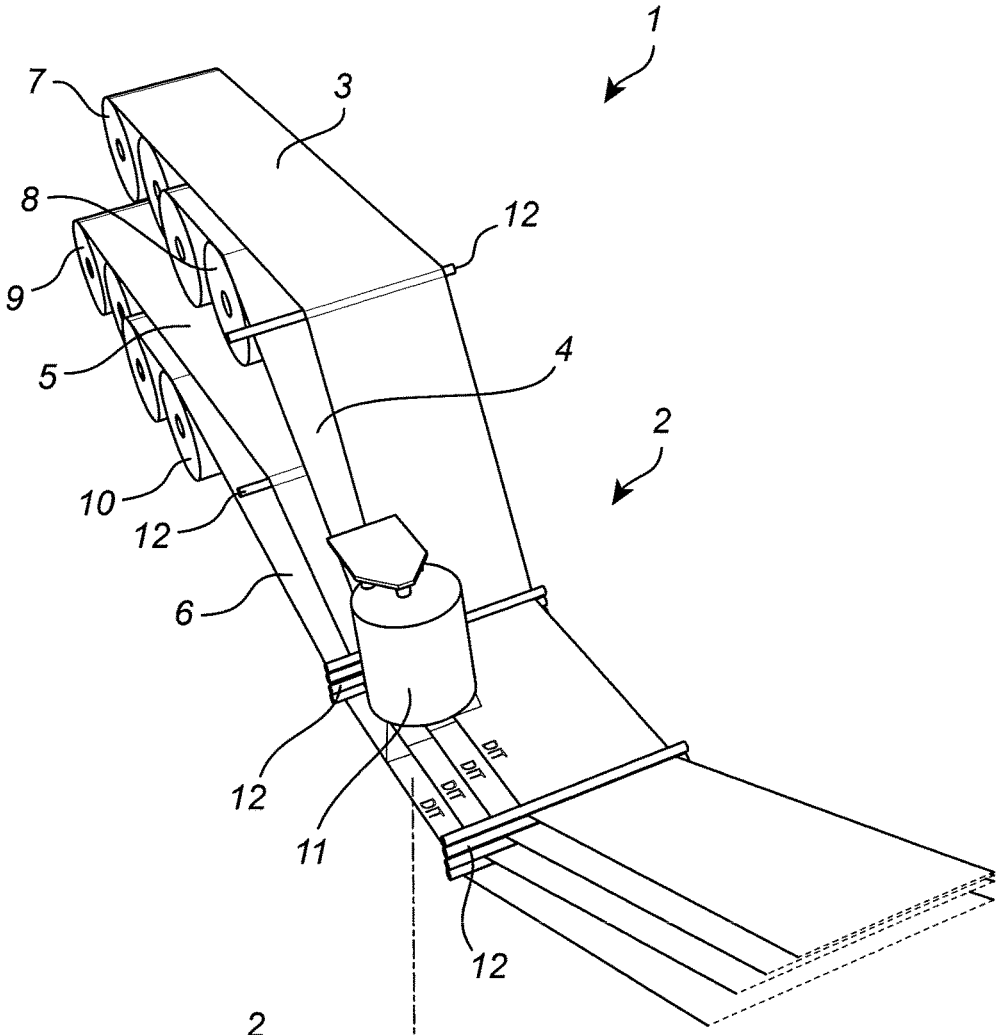
FIG. 1*a* is a side view of a multilane wrapping machine according to one exemplary embodiment of the invention.
Figure 1B:
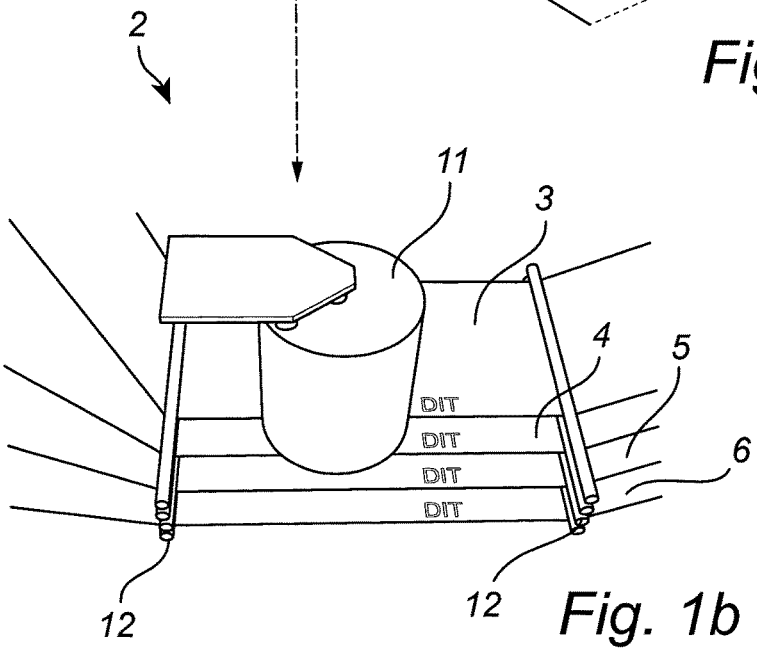
FIG. 1*b* is an enlargement of a portion of the wrapping machine in FIG. 1*a*.

FIGS. 1*a* and 1*b* illustrate a multilane wrapping machine 1 according to one exemplary embodiment of the invention. The wrapping machine 1 comprises a printer 2 and four lanes 3, 4, 5, 6 for packaging material. The lanes 3, 4, 5, 6 for packaging material are arranged substantially on top of each other but in an overlapping manner. That is, they are arranged laterally offset and offset in height so that an outer edge of the packaging material of each lane 3, 4, 5, 6 is exposed. A printer head 11 of the printer 2 is arranged in direct connection with and above the lanes 3, 4, 5, 6. This way, the printer 2 will be able to simultaneously print a printing on the outer edge of the packaging material travelling in each lane 3, 4, 5, 6 using one single printer head. Normally, the print includes a date coding and/or a batch number. However, other prints are naturally also possible.

As can be seen in FIG. 1*a*, each lane 3, 4, 5, 6 comprises a roller 7, 8, 9, 10 onto which the packaging material is wound. The rollers 7, 8, 9, 10 are preferably arranged laterally offset and offset in height in order to achieve the desired relationship between the packaging material of the different lanes 3, 4, 5, 6 when passing the printer 2. Further, each lane 3, 4, 5, 6 comprises at least one guiding means 12 (specifically between two and three in this embodiment) which will guide the packaging material in each lane 3, 4, 5, 6 from the roller 7, 8, 9, 10, to the printer 2, and further downstream of the printer 2 in the wrapping machine 1.

Figure 2:
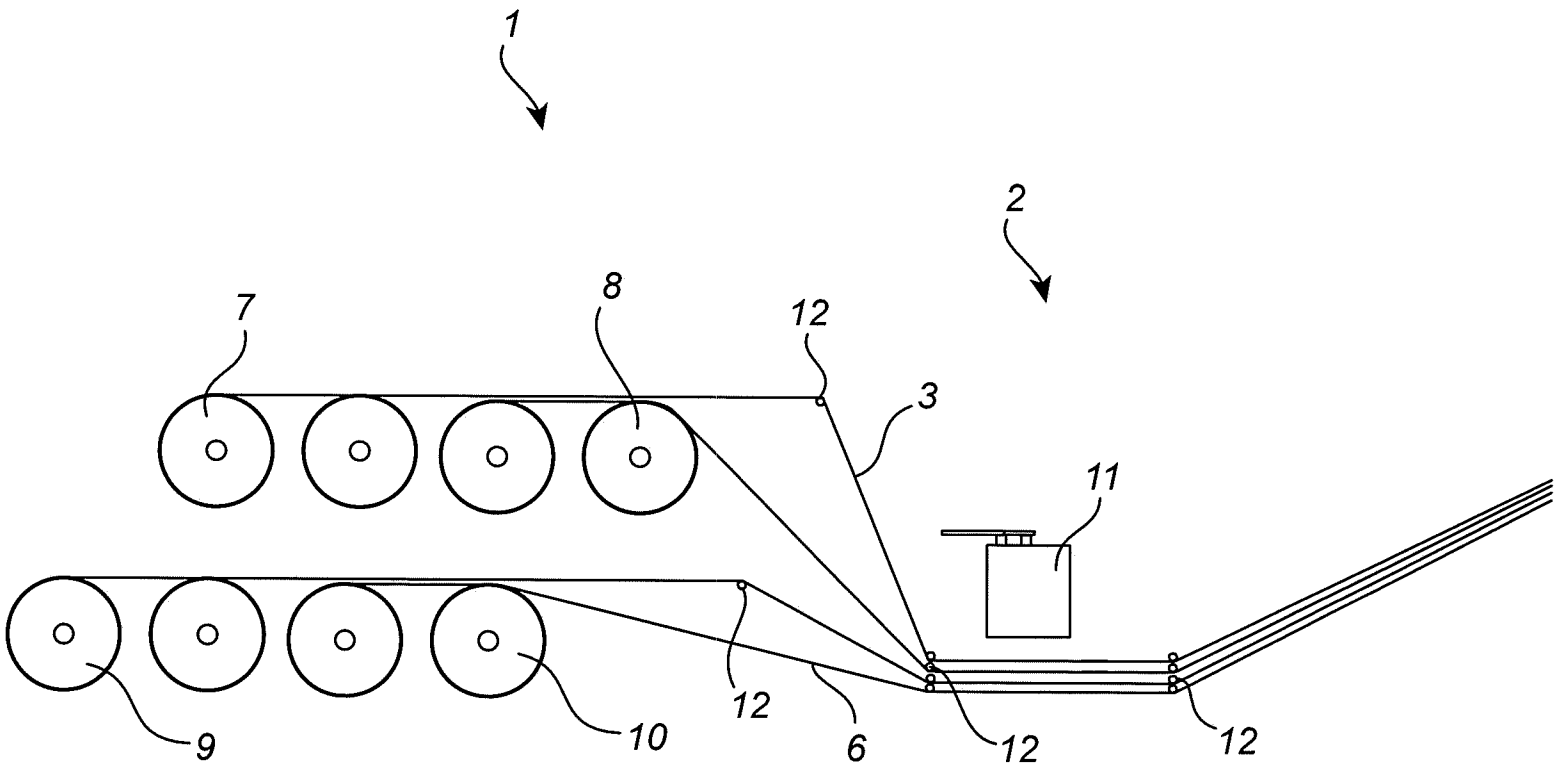
FIG. 2 is a side view of the multilane wrapping machine in FIG. 1*a*.

In FIG. 2 it is more clearly illustrated that the lanes 3, 4, 5, 6 of packaging material are offset also in height in relation to each other. The distance between the printer head and the packaging material of the lane 6 arranged furthest away from the printer head preferably is between 20 and 500 mm. This is a distance from which a clear print in the required size can be provided on the packaging material by means of the printer 2. Here, a 175 mm focal length is used and the focal distance is approximately 14 mm. However, naturally, other alternatives are also possible.

When the packaging material has been printed on it proceeds through the wrapping machine 1 to receive an object and to be formed into a package downstream of the printer 2. The packaging material of each lane 3, 4, 5, 6 is used to create an individual package, respectively. That is, if the wrapping machine 1 comprises four lanes 3, 4, 5, 6 of packaging material then four individual packages are simultaneously and continuously created downstream of the printer 2.

Figure 3:
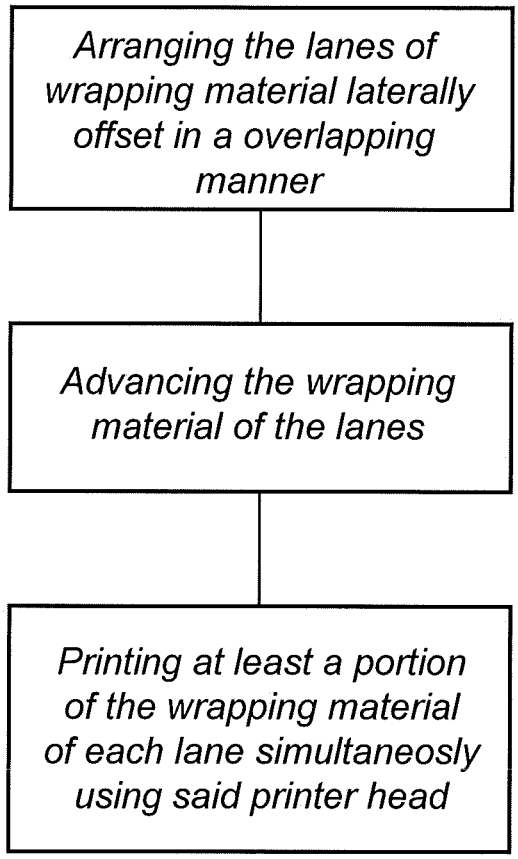
FIG. 3 is a flow chart of a method for simultaneously printing a plurality of lanes of packaging material according to one exemplary embodiment of the invention.

FIG. 3 illustrates a flow chart of the steps in an exemplary method for simultaneously printing a plurality of lanes of packaging material using one single printer head according to the invention. The method comprises the steps of arranging the lanes laterally offset in an overlapping manner, advancing the packaging material of the lanes, and printing at least a portion of the packaging material of each lane simultaneously using the printer head.

It is understood that other variations in the present invention are contemplated and in some instances, some features of the invention can be employed without a corresponding use of other features. Accordingly, it is appropriate that the appended claims be construed broadly in a manner consistent with the scope of the invention.

For instance, the printer may be a static printer or a laser printer. The number of lanes may be varied in any suitable manner. In one preferred embodiment of the invention, up to twelve lanes are used.

The printer as described above may be used in any suitable context and is not limited for use in connection with a wrapping machine. It may, for example, be used for printing on carton based packaging material or on labels or the like for different types of products.

The invention claimed is:

1. A multilane printer for printing packaging material, comprising a first lane for packaging material, a second lane for packaging material, and a printer head arranged in connection with said lanes, wherein said lanes are arranged laterally offset in an overlapping manner, such that said printer head is able to simultaneously print on at least a portion of the packaging material travelling in each lane.

2. The printer according claim 1, wherein said lanes are arranged offset in height when passing said printer head.

3. The printer according to claim 1, wherein said printer is a static printer.

4. The printer according to claim 1, further comprising a third lane for packaging material.

5. The printer according to claim 4, further comprising a fourth lane for packaging material.

6. The printer according to claim 1, wherein said portion of the packaging material is an edge of the packaging material.

7. The printer according to claim 1, wherein said print comprises a date coding and/or a batch number.

8. The printer according to claim 1, wherein said printer is a laser printer.

9. The printer according to claim 1, wherein a distance between said printer head and said packaging material of the lane arranged furthest away from said printer head is between 20 and 500 mm.

10. A multilane wrapping machine for wrapping objects in bags of packaging material, comprising a printer according to claim 1.

11. The wrapping machine according to claim 10, further comprising a roller for each lane of said printer onto which said packaging material is wound.

12. The wrapping machine according to claim 10, further comprising at least one guiding means for each lane of said printer adapted to guide the packaging material in said lane.

13. A method for simultaneously printing a plurality of lanes of packaging material using one single printer head, comprising:

arranging said lanes laterally offset in an overlapping manner; advancing the packaging material in said lanes; and printing at least a portion of the packaging material in each lane simultaneously using said printer head.

* * * * *